United States Patent [19]

Jordan et al.

[11] Patent Number: 4,881,325

[45] Date of Patent: Nov. 21, 1989

[54] STATIC FREE CLOTHES DRYER

[76] Inventors: Raymond L. Jordan; Rita A. Jordan, both of Rte. 2, Box 139A, Tonganoxie, Kans. 66086

[21] Appl. No.: 254,189

[22] Filed: Oct. 6, 1988

[51] Int. Cl.[4] ..... H05F 3/00

[52] U.S. Cl. ..... 34/60; 34/133; 361/212

[58] Field of Search ..... 34/133, 60, 90, 1; 361/212

[56] References Cited

U.S. PATENT DOCUMENTS 4,190,874 2/1980 Pasold ..... 34/133 X

*Primary Examiner*—Henry A. Bennet

*Attorney, Agent, or Firm*—Richard C. Litman

[57] ABSTRACT

An anti-static assembly for clothes dryers and like appliances includes contact members attached to the dryer vanes or forming the vanes themselves and which are electrically attached to a conductive band rotating with the dryer drum. Static electricity which builds up in the drum when drying clothes is conveyed from the contact members to the band where a pick-off apparatus collects the charges and conveys them to a ground point such that static charges are continuously neutralized by the assembly.

6 Claims, 1 Drawing Sheet

STATIC FREE CLOTHES DRYER

BACKGROUND OF THE INVENTION

During operation of clothes dryers, static electricity is created as a result of friction and it induces opposite electrical charges between the frictional pieces.

When clothes are dried in a rotary clothes dryer the tumbling action of the clothes causes enough friction between the clothes, and between the clothes and the drum's inner surface, to induce substantial charges of static electricity in the clothes, especially when synthetic fabrics are involved. More particularly, this electricity results when two specific types of materials, one having atoms which tend to part with electrons to adjacent atoms and the other having atoms which tend to remove electrons from adjacent atoms, are contacted or rubbed together. Such materials will take on opposite charges as friction causes electrons to be transferred from one material to the other. Static electricity is of opposite charges which attract each other, hence the clothes tend to stick to each other and this cling effect increases with friction. Another undesirable effect is that such static charge also attracts lint which clings to clothes.

The static charges are not known to be very harmful, but they are a noticeable problem and it is highly desirable to provide a means of neutralizing the static charges before the clothes are removed from the clothes dryer.

DESCRIPTION OF THE RELATED ART

In the past, devices such as magnets have been placed in the clothes dryer whereby the resulting magnetic field effects a neutralization of the static charges in the clothes. U.S. Pat. No. 3,991,479 to Dionne discloses such a device. U.S. Pat. No. 3,161,479 to Biderman discloses a device which produces a single polarity electrical charge across the dryer drum, so as to cause the mutual repulsion of items within the drum but no provision is made for the removal of the static charge. U.S. Pat. No. 4,618,909 to Sanders discloses a friction surface attached to the drum with a contacting shoe to remove the electrical charge from the drum. The frictional surfaces are of generally non-conducting materials and no provision is made to provide an electrical path from the interior of the drum, through any non-conductive coatings, to the outside of the drum. A grounded magnetized electrode is shown in U.S. Pat. No. 2,568,068. U.S. Pat. No. 3,643,349 to Lenz discloses a door actuated electrical grounding member with means to ground the dryer drum to the cabinet in response to opening the dryer door. Beane in U.S. Pat. No. 4,631,630 discloses the concept of adding a reusable static dissipating fabric to the clothes being dried in the dryer.

While the means and methods disclosed in the aforementioned patents may comprise attempts to overcome the undesirable and troublesome effects of static electricity which builds up in clothes dryers, they do not show or suggest the concept of the present invention.

SUMMARY OF THE INVENTION

By the present invention, an improved assembly is provided which readily lends itself to attachment to clothes dryers and like appliances to neutralize static electricity and remove the undesirable effects thereof. In general, an anti-static assembly for use in clothes dryers is provided comprising means for conducting electrical charges generated within a rotating drum, through the rotating drum and including means associated with the drum for conducting the electrical charges to gound to neutralize them. More specifically, electrical contacts are attached to or mounted upon the tumbler vanes or baffles inside the dryer drum and wires are run therefrom through and to the outside of the drum. These wires are attached to a band which is circumferentially attached or strapped to the outside of the drum so that it rotates continuously as the drum rotates. An electrical contact brush is mounted adjacent this band so as to be in frictional contact therewith. The brush is electrically and independently grounded whereby clothes tumbling in the rotating drum during the drying process are electrically neutralized and static electricity eliminated.

It is therefore an object of the present invention to provide an improved device for discharging or continuously neutralizing any build-up of static electricity in a clothes dryer or like appliance.

Another object is to provide a static discharge assembly which is easily installed either by the consumer or during the manufacture of a conventional dryer or like appliance.

A further object is to provide a static electricity device that is inexpensive to manufacture and of simple operation and includes a plurality of contacts on the vanes of a rotating dryer, electrically connected top pick up means on the exterior of the drum.

With these and other objects in view which will more readily appear as the nature of the invention is better understood, the invention consists in the novel construction, combination and assembly hereinafter more fully illustrated, described and claimed, with reference being made to the accompanying drawings.

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
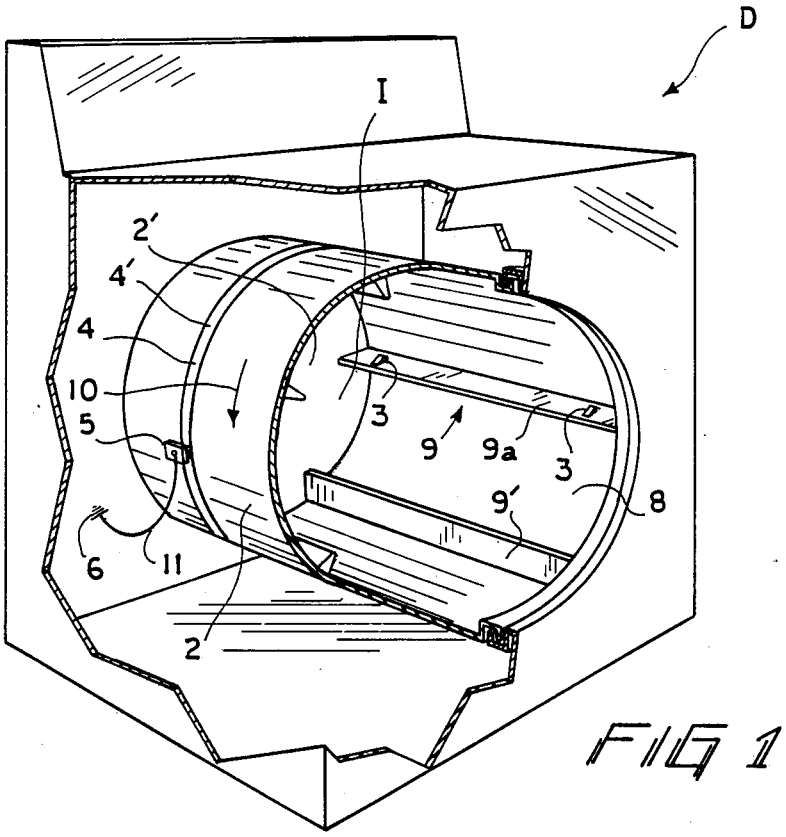
FIG. 1 is a perspective view of a clothes dryer including the static discharge assembly of the present invention.

In order to fully explain and demonstrate the function of the invention, a clothes dryer D is represented in FIG. 1 and will be seen to include a cabinet or housing 1 containing an open-ended rotatable drying drum 2 adapted to receive, through a front cabinet and drum opening 8, clothing articles to be dried. A cabinet door (not shown) provides access to the interior I of the drum 2. Formed as an integral part of the drum 2 are a series of inwardly directed tumbler vanes or baffles 9. These vanes 9 may be of any configuration, but normally are triangular in cross section so as to provide an interior edge **9*a* projecting inwardly of drum 2**.

Figure 2:
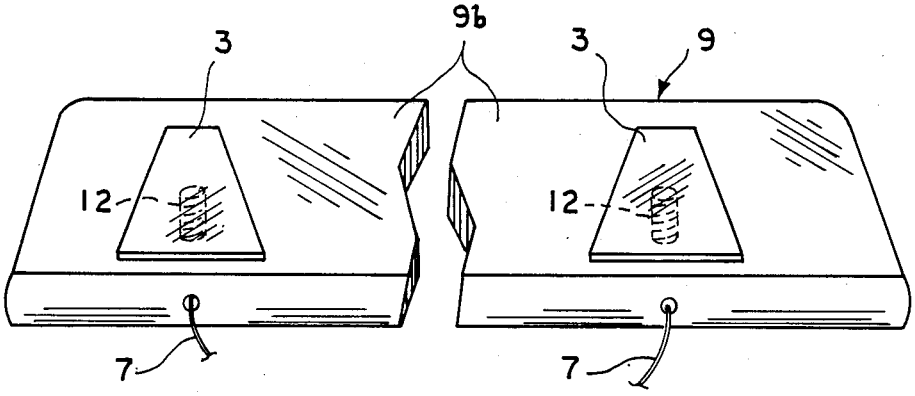
FIG. 2 is an enlarged fragmentary view showing a vane or baffle of the dryer drum with the electrical contact bars attached.

The anti-static assembly of this invention comprises a plurality of electrically conductive contacts 3 which are preferably attached to the vanes 9 inside the dryer for contacting clothes during the drying process. In this regard the generally planar contact surfaces 3 will be understood to be mounted on the leading face **9*b* of the vanes, as determined by the direction of drum rotation and which is reflected by the arrow 10 in FIG. 1. Alternately, the contact member 3 may be elsewhere mounted within the drum interior. Wires 7 (FIG. 2) are joined to the undersurface of the electrical contacts 3 and extend to the outside surface of the dryer drum 2. These wires 7 are thence attached to a continuous conductive band 4 which is attached at any point, to the exterior circumference of drum 2 and rotates therewith. Alternately, the band may comprise a flat ring (not shown) mounted on the rear surface of the drum end wall 2'. A relatively stationary conductive brush 5 is in frictional contact with band 4 and is in turn connected to the electrical ground 6 of the dryer by means of a wire conductor 11. When clothes are being dried in the dryer in a conventional manner, they repeatedly engage the contact members 3 of the vanes 9, and built-up electrical charges thereon will flow from these contact members through the wires 7, to the encircling band 4 and to ground via the brush 5 and wire 11** whereby electrical charges are constantly drawn off and neutralized.

In attaching the anti-static assembly of this invention, the contact members 3, made of brass or other electrically conductive material are shaped to fit adjacent the ends of the dryer vanes 9. Attachment may be achieved by means of electrically conductive bolts 12 secured to the contacts 3. Holes are drilled in the vanes and the bolts 12 passed therethrough for attachment to the vanes. Wires 7 are connected to the bolts on the interior or underside of the vanes and then passed through holes in the dryer drum 2 and attached to the band 4. As noted above, the band 4 is in frictional contact with a grounded brush 5 constructed of carbon or other electrically conductive material. Band 4 is constructed of thin brass or other electrically conductive material, cut to fit the drum 2 and the ends 4', 4' are attached, preferably in an overlapping manner for strength.

FIG. 1 also illustrates an alternative embodiment wherein the contact member comprises one or more bars 9', similarly electrically joined to the wires 7, band 4, brush 5 and grounding wire 11. Such bars 9' may be in lieu of or in addition to, regular tumbling vanes in the drum.

In the case of a double drum dryer wherein the rotating drum is concentrically mounted within a stationary outer drum (not shown), an end user may experience difficulty in retrofitting such a dryer with the above-described construction, wherein access to the inner drum exterior surface is required. In such installations, the static pick-off may comprise a commutator-like ring carried by the driven mounting shaft of the inner rotating drum.

The anti-static assembly, because of its independence from other electrical components of the dryer, will not be detrimental to its operation or to clothes dried therein. It will retain its capacity to neutralize electrical charges over an extremely long period of time without replacement.

While we have illustrated and described the preferred form of construction for carrying our invention into effect, this is capable of variation and modification without departing from the spirit of the invention. For example, while a specific rotating drum has been shown, the anti-static assembly of this invention is adaptable to many dryer or like appliance designs as noted above. We, therefore, do not wish to be limited to the precise details of construction as set forth, but desire to avail ourselves of such variations and modifications as come within the scope of the appended claims.

We claim:

1. An anti-static assembly for use in clothes dryers and like appliances having a rotatable drying drum including:

contact means within the drum engageable with clothes being tumbled therein and adapted to collect electrical charges from the clothes; and conductive means joining said contact means within the drum to a stationary ground discharge point, said conducting means comprising an electrically conductive band surrounding the dryer drum, wiring connecting said contact means to said band, and stationary brush means engageable with said band, whereby electrical charges built up in clothes in the dryer are neutralized.

2. The anti-static assembly of claim 1 wherein, said contact means includes tumbler vanes within the drum constructed of electrically conductive material.

3. The anti-static assembly of claim 1 wherein, the dryer drum includes tumbler vanes, and said contact means including substantially planar conductive contact members mounted on the vanes.

4. The anti-static assembly of claim 2 including, wiring connecting said tumbler vanes to said band.

5. The anti-static assembly of claim 3 including, wiring connecting said planar contact members to said band.

6. The anti-static assembly of claim 5 including, bolt means attached to said contact members and mounting said contact members to the vanes.

* * * * *